US008485373B2

(12) United States Patent
Antier et al.

(10) Patent No.: US 8,485,373 B2
(45) Date of Patent: Jul. 16, 2013

(54) STOPPER DEVICE FOR STOPPING A CONTAINER NECK

(75) Inventors: Gregory Antier, Trevoux (FR); Michel Luzzato, Ecully (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 311 days.

(21) Appl. No.: 12/918,792

(22) PCT Filed: Feb. 24, 2009

(86) PCT No.: PCT/FR2009/050291
§ 371 (c)(1),
(2), (4) Date: Aug. 20, 2010

(87) PCT Pub. No.: WO2009/112752
PCT Pub. Date: Sep. 17, 2009

(65) Prior Publication Data

US 2011/0000928 A1 Jan. 6, 2011

(30) Foreign Application Priority Data

Feb. 26, 2008 (FR) ..... 08 51224

(51) Int. Cl.
*B65D 41/32* (2006.01)

(52) U.S. Cl.
USPC ..... 215/253; 215/235

(58) Field of Classification Search
USPC ..... 215/253, 250, 237, 235; 220/265
See application file for complete search history.

(56) References Cited

U.S. PATENT DOCUMENTS

| | | | | |
|---|---|---|---|---|
| 2,252,217 | A * | 8/1941 | Stewart | 53/138.1 |
| 4,271,972 | A * | 6/1981 | Thor | 215/251 |
| 4,555,038 | A * | 11/1985 | Nagel, Jr. | 215/235 |
| 5,678,719 | A * | 10/1997 | Adams et al. | 220/266 |
| 5,853,093 | A * | 12/1998 | Neiger | 215/237 |
| 6,347,716 | B1 * | 2/2002 | Nofer et al. | 215/235 |
| 6,398,067 | B1 * | 6/2002 | Belfance et al. | 220/833 |
| 6,931,821 | B2 * | 8/2005 | Wong | 53/420 |
| 2005/0023238 | A1 * | 2/2005 | Wong | 215/252 |
| 2007/0235406 | A1 * | 10/2007 | Young | 215/253 |

FOREIGN PATENT DOCUMENTS

| | | |
|---|---|---|
| EP | 1174359 | 1/2002 |
| EP | 1619135 | 1/2006 |
| WO | 2004/007313 | 1/2004 |

* cited by examiner

*Primary Examiner* — Mickey Yu
*Assistant Examiner* — Niki Eloshway
(74) *Attorney, Agent, or Firm* — Finnegan, Henderson, Farabow, Garrett & Dunner, LLP

(57) ABSTRACT

The invention relates to a plugging device (1) that comprises a base (10) secured around the neck (2) and a cap (20) supported by the base and capable of movement between a closed and an open position. In order to improve the tamper-proof characteristic of the device, the invention comprises using, on the one hand, a breakable thread (30) having at least one longitudinal end permanently connected to a first portion (211) of the cap or the base and extending, before breaking, lengthwise along the periphery of said portion and, on the other end, a lug (40) permanently connected to another portion, respectively, of the base or the cap, and protruding towards the outside from said second portion. The lug is adapted to press at least on the free part of the thread until the thread is broken at a breaking area along the thread when the cap is moved for the first time from the closed position to the open position thereof, and to be interposed between the edges of said breaking area when the cap is then placed back into its closed position.

13 Claims, 6 Drawing Sheets

130B
119
143B
140
-111$_1$-
130A
143A
110

141
131B
130B
130$_2$
119
140
131A
130A
130$_1$
-111$_1$-
110

121
141
119
130
130$_2$
130$_3$
131
130$_1$
-121$_1$-
142
140
-111$_1$-
120
110

STOPPER DEVICE FOR STOPPING A CONTAINER NECK

The present invention relates to a stopper device for stopping a container neck.

In the field of packaging of liquids, it is common to equip the threaded or non-threaded neck of a container with a stopper that is generally made of a molded plastics material, that includes a lid carried pivotally by a base of tubular overall shape, and that is designed to be held stationary around the neck. This type of device, commonly referred to as a "sport stopper" or as a "sport cap", is used to enable the user to drink directly from the neck of the container, after having pivoted the lid to a position in which it is far enough away from the base to enable the liquid contained in the container to flow through said base.

Before that type of stopper device is used for the first time, i.e. before the lid is opened for the first time, the lid and the base are connected together by tamper-proofing means that are suitable for being broken at least in part when the device is opened for the first time. Such tamper-proofing means thus, in principle, give the user a visual indication as to whether or not the device being used by the user has been opened previously. Such a visual indication is glaringly obvious when at least a portion of the tamper-proofing means is totally separated from the remainder of the device. However, in such a situation, the separated portion, which is generally of small size, poses a safety problem because it might be ingested or inhaled, and also an environmental problem because the user tends to discard it without bothering to throw it away in a trash can.

In order to surmount these problems, known ways of implementing such tamper-proofing means consist in making provision for at least a portion of said means to be sufficiently spaced apart from the remainder of the device to give a sufficient visual indication, while also remaining connected permanently to the device, typically via a non-breakable elongate bridge of material. However, in such a situation, that partially detached portion of the tamper-proofing means frequently constitutes a hindrance to the user when the user drinks directly from the neck of the bottle. In addition, said partially detached portion generally has a length sufficient to be easy to grasp and to be twisted through several turns by the user, until it is totally separated from the stopper device, with the safety and environmental problems that are mentioned above.

A third known solution consists in reinforcing the tamper-proofing means so as to prevent them from separating from the remainder of the device, except at one or more small breakable zones at which very localized breaking takes place when the device is opened for the first time. Unfortunately, in such a situation, the visibility of the broken or the unbroken state of the tamper-proofing means is very low, thereby obliging the user to look very carefully at the device in order to determine whether it has been opened for a first time.

An object of the present invention is to improve the tamper-proofing means of stopper devices having pivotally mounted lids or, more generally, having moving lids of the same type, so that, while being effective, the tamper-proofing means offer better visibility and limit the risks of them being separated, even partially, from the remainder of the stopper device.

To this end, the invention provides a stopper device for stopping the neck of a container as defined in claim 1.

The basic idea of the invention is to provide, as tamper-proofing means, a system based on the principle of a "fuse wire" forming a mechanical fuse. In accordance with the invention, the strand of material gives the user a remarkably clear visual indication of whether or not the lid has been opened for a first time, i.e. of whether or not said lid has been moved from its closed position towards its open position, without necessarily reaching said open position. For this purpose, so long as the device of the invention has not been opened for a first time, said strand of material is intact, i.e. non-broken. Breakage of the strand of material is dependent on the presence of the "breaker" stud in that, when the device is opened for the first time, the relative movement between the strand and said stud results in the stud applying mechanical stresses on the main portion of the strand that are sufficiently strong to cause said strand to break. After the device has been opened for the first time, the strand of material is thus necessarily broken: because of the structural flexibility of the strand of material and of the presence of the stud, the broken strand then has a configuration different from the configuration that it had before breaking, which is immediately observed by the user.

In accordance with the invention, before breaking, the strand of material extends in a peripheral direction of the device, so that, after the strand breaks, no portion of said strand projects radially outwards: the presence of the broken strand does not hinder the user in drinking directly from the outlet of the device, and the risks that the user might easily take hold of the entire broken strand or of some part of it and twist it through several turns are low, or indeed almost zero. If that were to happen, the dimensions of the detached strand portion would then advantageously be too small to block off the respiratory tract in the event of ingestion.

Additional advantageous characteristics of the stopper device of the invention, taken in isolation or in any technically feasible combination, are specified in the dependent claims 2 to 12.

The invention can be understood more clearly on reading the following description given merely by way of example, and with reference to the drawings, in which.

Figure 2:
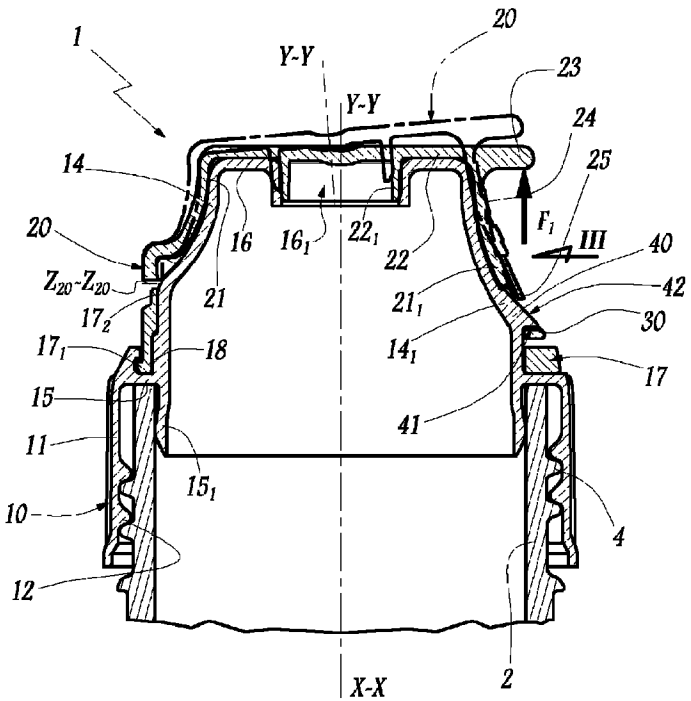
FIG. 2 is a longitudinal section view on plane II of FIG. 1.

FIGS. 1, 2, and 3A to 3C show a stopper device 1 for stopping a neck 2 of a container such as a bottle. For reasons of convenience, in the description below, the terms "top" and "upwards" refer to a direction extending away from the body on the other side of the neck 2 from the body 3 while the bottle is standing vertically on a horizontal surface, which direction thus extends towards the tops of FIGS. 1, 2, and 3A to 3C. The terms "bottom" and "downwards" refer to the opposite direction. The same conventions are used for describing FIGS. 4A to 4C, 5, 6, and 7A to 7C.

The device 1 has a base 10 that is of tubular overall shape centered on an axis X-X. The base 10 comprises a main body 11 having a tubular shape that is of substantially circular base and that is centered on the axis X-X. The body 11 is adapted to be mounted in stationary manner around the neck 2 of the bottle, by screw-fastening in this example: the body is thus provided with an inside thread 12 that is complementary to an outside thread 4 of the neck, while the outside face of the body 11 is provided with longitudinal splines 13 making it easier to take hold of the base 10 for the purpose of screwing it onto the neck.

The base 10 also has a teat 14 that is of tubular overall shape centered on the axis X-X and tapering upwards. The bottom portion of the teat 14 is connected rigidly to the top portion of the body 11, in this example by being formed integrally therewith, via a horizontal wall 15. On its bottom face, the wall has a cylindrical sealing skirt $\mathbf{15}_1$ adapted to bear in leaktight manner against the inside face of the top end of the neck 2 when the base 10 is fastened to the neck, as shown in FIG. 2. At its top end, the teat 14 is closed by a horizontal end wall 16 that defines a cylindrical opening $\mathbf{16}_1$ in its central region.

The base 10 also has a band 17 for assembling a lid 20. In this example, the lid and the band are formed integrally as a single part.

The lid 20 is of tubular overall shape centered on a longitudinal axis Y-Y. For this purpose, the lid has a tubular main body 21 centered on the axis Y-Y and tapering slightly upwards. The body 21 is closed, at one of its longitudinal ends, by an end wall 22 that extends in a plane perpendicular to the axis Y-Y and that is provided, on its face facing towards the inside of the body 21, with a cylindrical sealing skirt $\mathbf{22}_1$. This skirt $\mathbf{22}_1$ is dimensioned to be inserted into the opening $\mathbf{16}_1$ so as to close off said opening in substantially leaktight manner. The lid 20 is thus suitable for stopping the neck 2 by closing the base 10.

The lid 20 is carried by the base 10 in such a manner as to be movable between a closed position that is shown in the figures and in which the body 21 covers the teat 14 with the skirt $\mathbf{22}_1$ closing off the opening $\mathbf{16}_1$, the axes X-X and Y-Y then substantially coinciding, and an open position, in which the lid is far enough away from the teat 14 for the opening $\mathbf{16}_1$ to communicate freely with the outside and, when the base 10 is assembled to the neck 2, for a user to pour the liquid contained in the bottle body 3 through said opening, via the neck, in particular by bringing the teat 14 directly to the mouth.

To this end, the lid 20 is mounted to pivot about a hinge axis $Z_{20}$-$Z_{20}$ that extends along a direction that is substantially circumferential to the axes X-X and Y-Y. Said axis $Z_{20}$-$Z_{20}$ is situated in a portion of the base 10 that is considered to be a rear portion, in the sense that said portion of the base faces away from the user who is handling the device 1. The lid 20 then, advantageously reversibly, goes between its closed and its open positions by pivoting as a whole about the axis $Z_{20}$-$Z_{20}$, an intermediate pivoting position being shown partially in chain-dotted lines in FIG. 2.

In order to drive the lid 20 to pivot, said lid is provided with a front tab 23 that extends in the same plane as the end wall 22, and that overlies a depression 24 provided in the front of the body 21. In this way, a user can place a finger in the depression 24 and press against the surface of the tab 23 that faces towards the depression, in order to apply a force $F_1$ directed upwards and along an axis that is substantially parallel to the axis Y-Y, as shown in FIG. 2.

The assembly band 17 has a main body $\mathbf{17}_1$ that is substantially annular and that is adapted to be mounted in such a manner as to be stationary and coaxial relative to the remainder of the base 10. In the embodiment considered herein, the body $\mathbf{17}_1$ is received and held stationary, in particular by snap-fastening, in a complementary recess 18 that is defined jointly by the top end of the body 11, by the wall 15, and by the bottom end of the teat 14, as can be seen clearly in the left portion of FIG. 2.

The body $\mathbf{17}_1$ is, in a rear portion, connected permanently and deformably to the body 21 of the lid 20, by forming one or more strips $\mathbf{17}_2$ forming a hinged connection of the flexible hinge type between the lid 20 and the band 17, while defining the pivot axis $Z_{20}$-$Z_{20}$.

By way of tamper-proofing means, the device 1 also has a strand of material 30 and a stud 40. In the embodiment shown in FIGS. 1, 2, and 3A to 3C, the strand 30 is connected permanently to the body 21 of the lid 20: the front portion $\mathbf{21}_1$ of the body 21 is provided with a through radial perforation, i.e. said portion $\mathbf{21}_1$ defines a through window 25 having a bottom edge, i.e. an edge extending in the peripheral direction of the body 21, that is constituted by the strand 30. Advantageously, the strand 30 and the body 21 are formed integrally as a single part, in particular by molding, so that, as can be seen clearly in FIG. 3A, the longitudinal ends $\mathbf{30}_1$ and $\mathbf{30}_2$ of the strand are formed integrally with the body portion $\mathbf{21}_1$.

The top edge of the window 25 is far enough away from the strand 30 for the window to receive the stud 40 that projects outwards from a front portion $\mathbf{14}_1$ of the teat 14, at the bottom portion thereof. In this example, the stud 40 is formed integrally with the teat 14, thereby facilitating fabrication by molding as a single part with the base 10.

Figure 1:
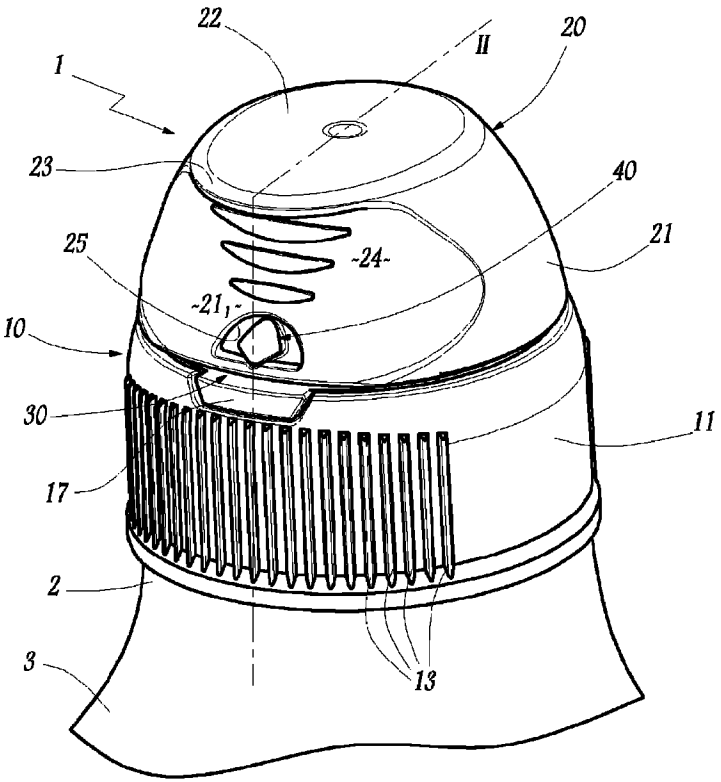
FIG. 1 is a perspective view of a stopper device of the invention, as assembled to the neck of a container and as not yet opened for the first time.
Figure 3C:
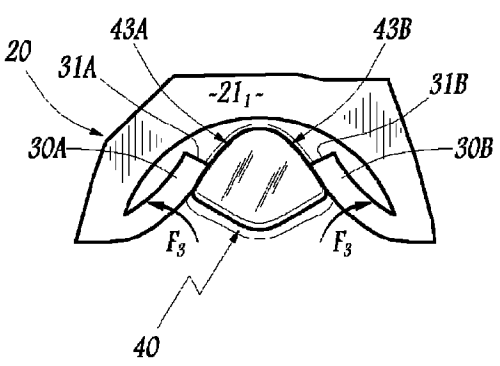
FIGS. 3B and 3C are diagrammatic views analogous to FIG. 3A, respectively showing the device being opened for the first time and it being closed subsequently.
Figure 3B:
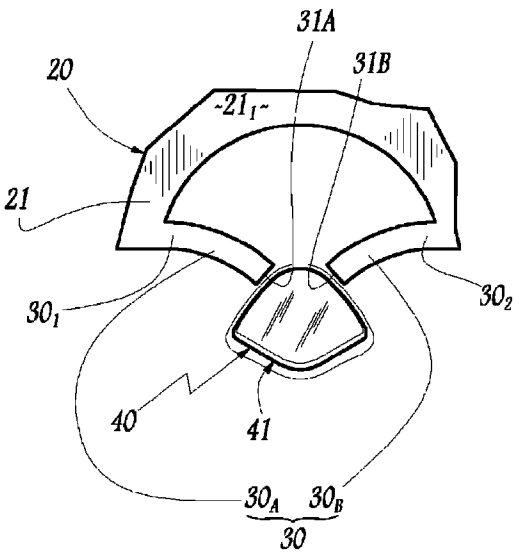
Figure 3A:
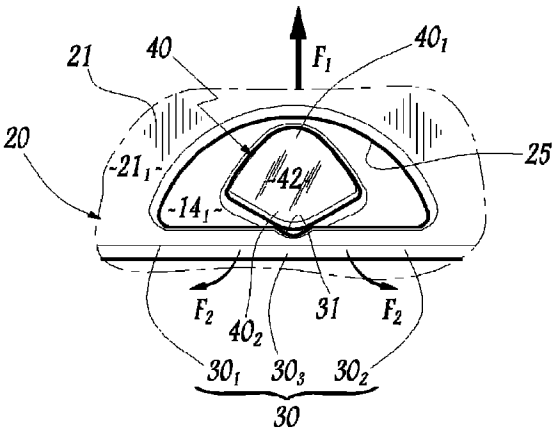
FIG. 3A is an elevation view seen looking along arrow III of FIG. 2, showing a portion of the device.

Going downwards along the axis X-X, the stud 40 has a radial dimension that increases: at its top $\mathbf{40}_1$, the thickness of the stud 40, i.e. its radial dimension projecting relative to the outside face of the front portion $\mathbf{14}_1$ of the teat is almost zero, whereas, at its bottom $\mathbf{40}_2$, this thickness is at a maximum, so that, on its bottom $\mathbf{40}_2$, the stud 40 defines a face 41 that, along the axis X-X, directly faces the main portion $\mathbf{30}_3$ of the strand 30 so long as the device 1 has not yet been opened for the first time, as shown in FIGS. 1, 2, and 3A. In this example, this face 41 is shaped to form a downwardly facing point, i.e. it comprises two substantially plane surfaces that converge downwardly towards each other and that, where they meet, form an angular zone pointing to the central portion of the main portion of the strand $\mathbf{30}_3$. Advantageously, this central portion has a thinner vertical thickness, i.e. its dimension along the axis X-X is smaller than the same dimension of the remainder of the strand 30. To this end, the central portion defines a notch 31 in which the angular zone of the face 41 is received, as can be seen clearly in FIGS. 1 and 3A.

In order to fabricate the device 1, the stud 40 and the base 10, except for its band 17, are advantageously obtained as a single part by molding a plastics material, and the lid 20, the strand 30, and the band 17 are advantageously obtained as a single part by molding a plastics material that may be identical or different from the above-mentioned material. In practice, the plastics materials used are chosen from polypropylene and polyethylene, among other materials.

The lid 20 is then assembled to the body 11 of the base 10, by snap-fastening the band 17 into the recess 18. During this assembly, the strand 30 must pass over the stud 40, from top to bottom, without being damaged. To this end, and because of the increasing radial thickness of the stud 40, the face 42 of said stud that faces outwards forms a ramp against which the strand 30 slides progressively while the lid 20 is being put into place relative to the base 10. This ramp face 42 progressively stresses the main portion $\mathbf{30}_3$ of the strand 30 outwards, the flexibility of the strand then being used advantageously to enable said main portion $\mathbf{30}_3$ to pass over the stud 40, until the main portion $30_3$ finds itself below the level of the face 41, said main portion $30_3$ then being positioned naturally immediately below said face, by resilient return of the material of the strand 30, in particular of its ends $30_1$ and $30_2$. The device 1 is then in the configuration shown in FIGS. 1, 2, and 3A.

The device 1 is used as follows. Initially, it is considered that the neck 2 of the bottle is closed by the device 1 that has not yet been opened for the first time, as shown in FIGS. 1, 2, and 3A. A user who wishes to open the device causes the lid 20 to pivot about the axis $Z_{20}$-$Z_{20}$ by applying the drive force $F_1$ on the tab 23, by means of one of the user's fingers that is inserted into the depression 24. The strand 30 then induces resistance to the drive of the lid: the main portion $30_3$ of the strand 30 is then pressed against the face 41 of the stud 40 to the extent that it causes the strand to break, at the notch 31, because thereat the strand is of lesser thickness, and is subjected to stronger stress due to the angular zone of the face 41. Once the user has thus overcome the low resistance induced by the strand 30 to the extent that said strand breaks, the user continues to pivot the lid 20 until the opening $16_1$ is completely unobstructed, while causing the lid to go via the intermediate position shown in FIG. 3B, also shown in chain-dotted lines in FIG. 2. As can be seen clearly in FIG. 3B, the strand 30 is then totally broken, in that, by the edges 31A and 31B of the broken notch 31 being spaced apart, the strand is made up of two distinct portions 30A and 30B, which are connected to respective ones of the sides of the window 25 via the strand ends $30_1$ and $30_2$, and which, opposite the ends $30_1$ and $30_2$, are terminated by respective ones of the edges 31A and 31B of the broken notch 31. The presence of the stud 40, in particular of its face 41, also constrains the two portions 30A and 30B to pivot downwards so as to pass beyond the stud 40, by the strand ends $30_1$ and $30_2$ deforming, as indicated by the arrows $F_2$ in FIG. 3A.

The strand 30 and the stud 40 are thus excellent tamper-proofing means: before the device 1 is opened for the first time, the user can make sure visually that the strand 30 is intact, said strand being particularly well observable by the user because it is situated specifically in an outside peripheral zone of the lid 20. If the strand 30 had been broken before the user started opening the device 1, even if the lid 20 were put back into its closed position, the strand portions 30A and 30B would no longer be in their initial configuration but rather, due to the presence of the projecting stud 40 disposed between them in such a manner as to be interposed between the edges 31A and 31B, said portions 30A and 30B would advantageously take up the configuration shown in FIG. 3C: in this example, as indicated by the arrows $F_3$, the strand portions 30A and 30B are pivoted by means of their ends $30_1$ and $30_2$ being deformed, by said portions bearing against respective ones of the surfaces 43A and 43B defined by the stud 40 on said opposite sides. To this end, said surfaces 43A and 43B diverge from each other going downwards.

Advantageously, the strand 30 breaks as described immediately above as soon as the lid 20 reaches an intermediate position between the open position and the closed position, said intermediate position being sufficiently close to the closed position to guarantee that the leaktightness between the lid and the teat 14 is maintained effectively, in particular at the skirt $22_1$ that is in leaktight abutment against the wall defining the opening $16_1$. It can be understood that said skirt and/or said wall can have a certain amount of resilience making it possible to achieve leaktight contact in spite of the small extent to which the lid 20 is spaced apart upwards from the base 10. Thus, before the device 1 is opened for the first time, when the user observes that the strand 30 has not broken, the user has a reliable guarantee that the device has not been willfully damaged, i.e. that the lid has not be previously tampered with in order to break the sealing of the device with a view to rendering the contents of the container equipped with the device 1 unfit for consumption.

Figure 4C:
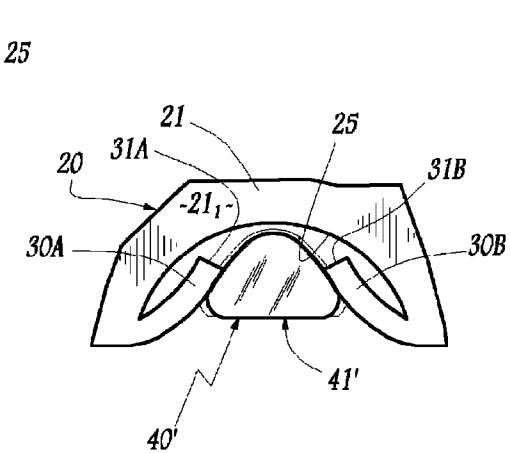
FIGS. 4A to 4C are views that are respectively analogous to FIGS. 3A to 3C, showing a variant embodiment of the device of the invention.
Figure 4B:
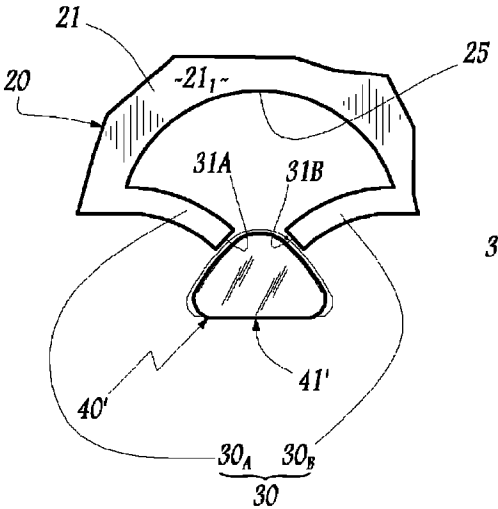
Figure 4A:
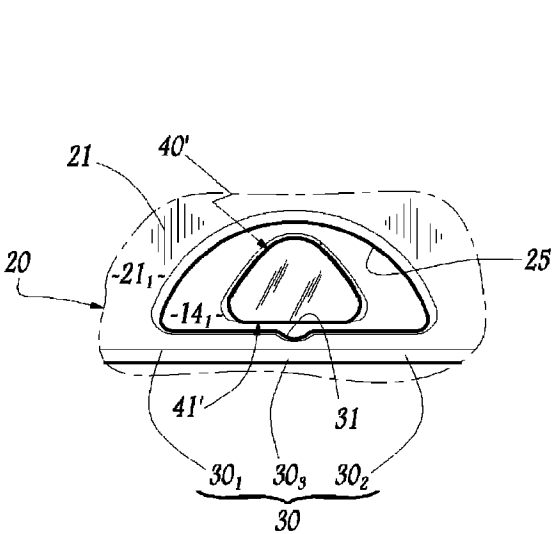

FIGS. 4A to 4C show a variant embodiment of the stud 40, referenced 40'. In this variant, the bottom face 41' of the stud 40' is not shaped to a point. Instead, it is substantially plane so as to cover the main portion $30_3$ of the strand 30, optionally with operational clearance being interposed. The other characteristics of the stud 40' are identical to the characteristics of the stud 40, so that the interaction between the stud 40' and the strand 30 is identical to the interaction between the stud 40 and the strand 30, except as regards the initial breakage of the strand 30: in this example, the entire face 41' participates in applying stress to the main portion of the strand $30_3$, until the strand breaks.

In practice, if said main portion $30_3$ has the notch 31, as shown in FIG. 4A, the strand breaks at said notch, due to it being weaker than the remainder of the strand. After the strand 30 has broken, the strand portions 30A and 30B behave with respect to the stud 40' in the same way as they behave with respect to the stud 40, as appears from FIGS. 4B and 4C by comparing them to FIGS. 3B and 3C.

Figure 5C:
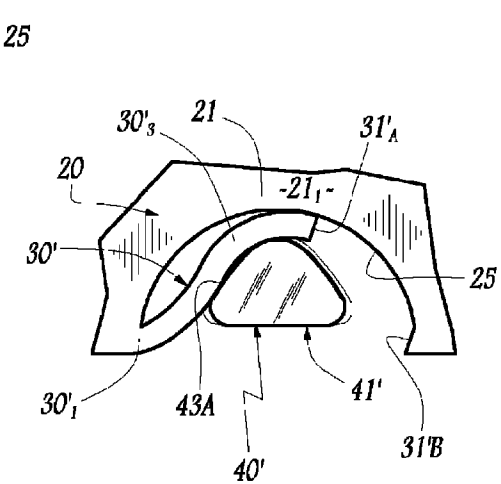
FIGS. 5A to 5C are views that are respectively analogous to FIGS. 3A to 3C, showing another variant embodiment of the device of the invention.
Figure 5B:
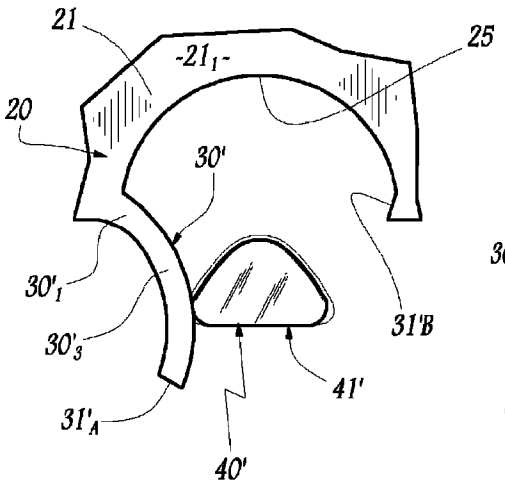
Figure 5A:
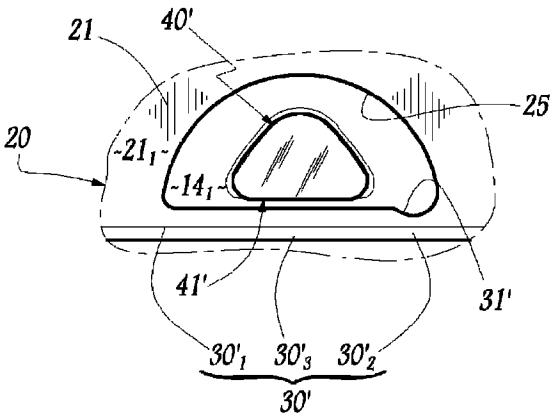

FIGS. 5A to 5C show a variant embodiment of the strand 30, referenced 30' and combined in this example with the variant of the stud 40'. In this variant of the strand 30', the zone in which the stand breaks when the device 1 is opened for the first time is not situated in the main portion $30'_3$ of the strand. Instead it is situated at the longitudinal end $30'_2$ thereof. The other longitudinal end $30'_1$ of the strand is identical to the end $30_1$ of the strand 30, with a view to guaranteeing that a permanent connection remains between most of the strand 30' and the portion $21_1$ of the lid 20. In practice, in order to ensure that the strand 30' breaks at its end $30'_2$, said end is thinner than the remainder of the strand, by having a notch 31' that is functionally analogous to the notch 31 in the strand 30.

When the lid 20 is opened for the first time, the face 41' of the stud 40' applies stresses to the strand 30' until its end 30'2 breaks. As shown in FIG. 5B, the edges 31'A and 31'B of the broken notch 31' then find themselves spaced apart because of the stud 40' being interposed, the main portion $30'_3$ of the strand being constrained to pivot downwards in order to pass beyond the stud, by the strand end $30'_1$ deforming. In other words, as appears from FIG. 5B, by comparing it with FIG. 4B, the main strand portion $30'_3$ behaves substantially in the same way as the strand portion 30A of the strand 30.

Similarly, when the lid 20 is the put back into its closed position, as shown in FIG. 5C, the main portion $30'_3$ of the strand 30' is pivoted upwards by the strand end 30'1 deforming, by said main portion bearing against the surface 43A of the stud 40'.

In addition, in an optional arrangement (not shown), rather than being plane, the bearing face 41' forms an angular zone pointing towards the strand end $30'_2$. In this way, the angular zone applies stronger stress at the notch 31', thereby making it possible to obtain the breakage more rapidly, i.e. at a pivot angle of the lid 20 that is smaller than the pivot angle necessary for breakage with the plane embodiment of the face 41' shown in FIGS. 5A to 5C.

FIGS. 6, 7, and 8A to 8C show another embodiment of a stopper device 100 that differs from the device 1 of FIGS. 1, 2, and 3A to 3C only as regards the tamper-proofing means: the second embodiment may be considered as being "symmetrical to" or "mirroring" the embodiment of FIGS. 1, 2, and 3A to 3C in that, rather than the base 10 and the lid 20 being respectively provided with the stud 40 and with the strand 30, the base 110 and the lid 120 of the device 100 are respectively provided with a strand 130 and with a stud 140.

More precisely, the base 110 is made up of the same components as the base 10, which components bear the same numerical references as those of the base 10, preceded by the digit "1", except that the top portion of its body 111, in the front portion $\mathbf{111}_1$ thereof, defines a window 119 that is functionally analogous to the window 25. In particular, the top edge of the window 119 is constituted by the strand 130 that extends in the peripheral direction of the front portion $\mathbf{111}_1$. The bottom edge of said window is downwardly far enough away from the strand 130 to receive the stud 140 that projects outwards from the front portion $\mathbf{121}_1$ of the body 121 of the lid 120, it being observed that said lid 120 otherwise has the same components as the lid 20, which components bear the same numerical references preceded by the digit "1".

Figure 7:
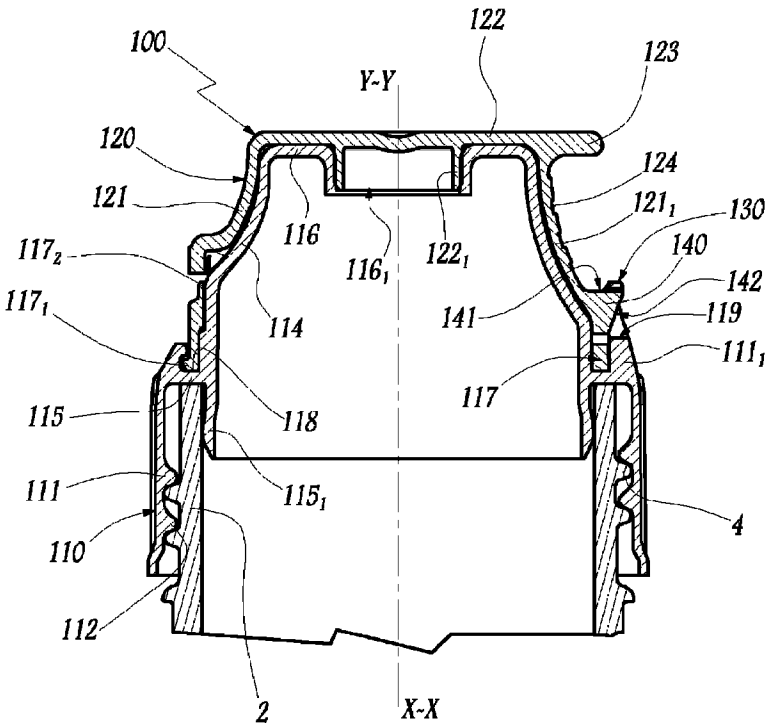
FIGS. 6, 7, and 8A to 8C are views that are respectively analogous to FIGS. 1, 2, and 3A to 3C, showing a second embodiment of a device of the invention.
Figure 6:
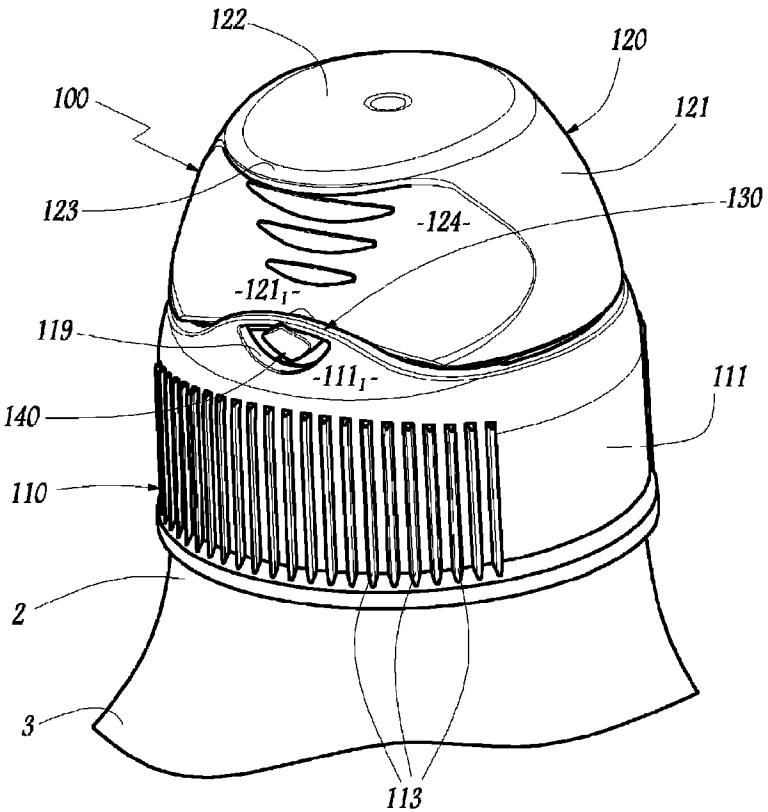
Figures 8A, 8B, 8C:
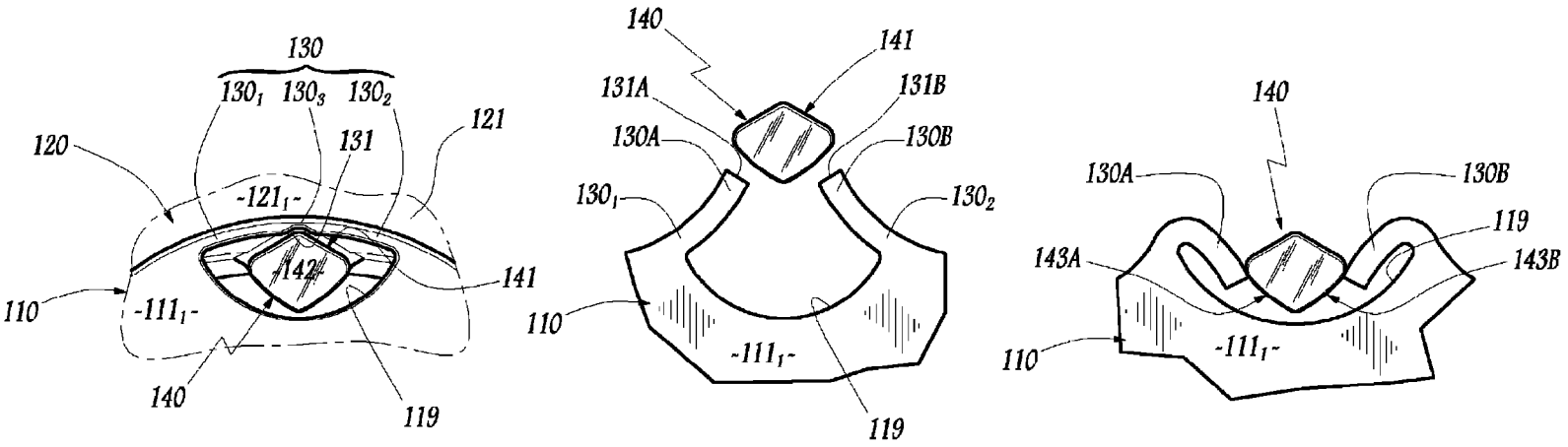

It can be understood, in particular, that the stud 140 defines a top face 141 that is functionally analogous to the face 41 of the stud 40 in that said face 141 bears against the main portion $\mathbf{130}_3$ of the strand 130, to the extent that said strand breaks into two distinct portions 130A and 130B when the lid 120 is moved for the first time from its closed position, shown in FIGS. 6, 7, and 8A, to its open position, while going via an intermediate position shown by FIG. 8B. In the same way as for the strand 30, breakage of the strand 130 is facilitated and concentrated by making provision for the central zone of the main portion $\mathbf{130}_3$ of the strand to be locally thinner, advantageously with it being provided with a notch 131 for receiving the angular zone of the point formed by the face 141, as can be seen clearly in FIG. 8A.

Similarly, and in the same way as for the strand ends $\mathbf{30}_1$ and $\mathbf{30}_2$, the strand ends $\mathbf{130}_1$ and $\mathbf{130}_2$ are deformed by the strand portions 130A and 130B deforming so as to allow the stud 140 to pass between the edges 131A and 131B of the broken notch 131 while the lid 120 is being opened, as shown in FIG. 8B, and while the lid is being subsequently closed as shown in FIG. 8C, the strand portions 130A and 130B then bearing against the upwardly divergent surfaces 143A and 143B defined on either side of the stud 140 and operating analogously to the surfaces 43A and 43B.

In addition, as can be seen clearly in FIG. 7, the radial dimension of the stud 140 decreases going downwards along the axis Y-Y, in such a manner that the face 142 of the stud that faces outwards forms a ramp for the strand 130, which ramp operates analogously to the ramp face 42 with respect to the strand 30, while the lid 120 is being initially assembled to the base 110.

Various arrangements of and variants to the stopper devices 1 and 100 are also possible. By way of example:

- the two variant embodiments considered with reference respectively to FIGS. 4A to 4C and to FIGS. 5A to 5C may be transposed, in isolation or in combined manner, to the embodiment considered with reference to FIGS. 6, 7, and 8A to 8C;
- in the example considered above, the strand 30, 30' or 130, and the stud 40, 40' or 140 are positioned in front of the base 10 or 110, and in front of the lid 20 or 120, in particular for reasons of good visibility by the user; in a variant, the strand and the stud can be provided in other peripheral portions of the device 1 or 100, in particular on one of the sides of the base and of the lid, substantially at 90° C. about the axes X-X and Y-Y relative to the tab 23 or 123; similarly, a plurality of strand-and-stud pairs may be provided, e.g. one on either side of the device;
- rather than being secured around the neck 2 by screw-fastening, the base 10 or 110 may be fastened by snap-fastening a portion of its bottom face to a complementary portion of the neck;
- the use of a strand and of a stud, respectively analogous to the strand 30, 30' or 130 and to the stud 40, 40', or 140, is possible for stopper devices other than those having pivotally mounted lids like the lids 20 and 120, provided that the lid of such a device moves away from the base upwards, away from the neck 2, when it is opened for the first time; and/or
- rather than making the base 10 or 110 and the lid 20 or 120 in two distinct pieces that are then assembled together, these two elements can be molded jointly, either with the lid in its closed position, or with the lid in a position in which it is out of its closed position, the lid then being moved, in particular pivoted, into its closed position while the strand 30, 30' or 130 slides against the ramp face 42 or 142 of the stud 40, 40' or 140.

The invention claimed is:

1. A stopper device for stopping a container neck, said stopper device comprising:

- a base that is substantially tubular and that is adapted to be fastened around the neck;
- a lid that is substantially tubular and that is carried movably by the base between a closed position, in which the lid closes off the base in a leaktight manner by covering it in part, and an open position, in which the lid is spaced apart from the base so as to enable a flow to pass through the base, the lid configured to be moved away from the neck when it leaves the closed position to go into the open position; and
- tamper-proofing means suitable for indicating visually whether the lid has already been pivoted from the closed position towards the open position, said tamper-proofing means comprising:
  - a breakable strand that, prior to breaking, extends lengthwise in a longitudinal direction which is along the periphery of a first portion of either the lid or the base, wherein the strand includes two longitudinal ends, which are opposed to each other in the longitudinal direction, and a main portion which prior to breaking of the strand, couples the two longitudinal ends to each other in the longitudinal direction, wherein at least one of the two longitudinal ends of the strand is connected permanently to the first portion; and
- a stud that is connected permanently to a second portion of the base or the lid and that projects outwards from said second portion, the stud being adapted to press against at least the main portion of the strand such that the stud is configured to break the strand at a break zone along the strand when the lid is moved for the first time from the closed position to the open position, and wherein the stud is interposed, along the periphery of the first portion, between two edges of said break zone when the lid is put back into the closed position.

2. A device according to claim 1, wherein the break zone of the strand is situated in the main portion of the strand, the two longitudinal ends of the strand then being connected permanently to the first portion whereas, when the lid is put back into the closed position after the strand has broken, the stud is interposed between two distinct portions of the broken strand.

3. A device according to claim 1, wherein the break zone of the strand is situated at one of the longitudinal ends of the strand, the other longitudinal end being connected permanently to the first portion.

4. A device according to claim 1, wherein the break zone is thinner relative to the remainder of the strand.

5. A device according to claim 1, wherein, before the strand breaks and while the lid is in the closed position, and along the axis associated with the first portion, the strand faces a bearing face of the stud,

6. A device according to claim 5, wherein the break zone is thinner relative to the remainder of the of the strand, and wherein the bearing face of the stud is shaped into a point pointing towards the strand before said strand breaks, the thinner break zone being constituted by a notch for receiving said point.

7. A device according claim 5, wherein the bearing face of the stud is substantially plane and it covers at least the main portion of the strand.

8. A device according to claim 1, wherein the first portion defines a radially through window, having one of its edges constituted by the strand and in which the stud is received when the lid is in its closed position.

9. A device according to claim 1, wherein, along an axis associated with the second portion, the stud has a radial dimension that decreases from the side of the stud that faces the strand before said strand breaks to the opposite side of the stud.

10. A device according to claim 1, wherein, on its two opposite sides in a peripheral direction of the second portion, the stud has respective surfaces that diverge going towards the strand before said strand breaks.

11. A device according to claim 1, wherein the strand and the stud are integral respectively with the first portion and with the second portion.

12. A device according to claim 1, wherein the strand is adapted to be broken by the stud when the lid is in an intermediate position between the closed position and the open position, and wherein the base remains closed off by the lid in the leaktight manner when the lid moves from the closed position to said intermediate position.

13. A device according to claim 1, wherein the lid is configured to pivot about an axis that is substantially circumferential to a central axis of the base, between the closed position and the open position.

* * * * *